US008919771B2

(12) United States Patent
Mori

(10) Patent No.: US 8,919,771 B2
(45) Date of Patent: Dec. 30, 2014

(54) SHEET CONVEYING APPARATUS AND IMAGE FORMING APPARATUS

(71) Applicant: Canon Kabushiki Kaisha, Tokyo (JP)

(72) Inventor: Hideki Mori, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/747,715

(22) Filed: Jan. 23, 2013

(65) Prior Publication Data

US 2013/0134664 A1 May 30, 2013

Related U.S. Application Data

(62) Division of application No. 13/182,504, filed on Jul. 14, 2011, now Pat. No. 8,382,099.

(30) Foreign Application Priority Data

Jul. 22, 2010 (JP) ..... 2010-165158

(51) Int. Cl.

| | |
|---|---|
| ***B65H 9/14*** | (2006.01) |
| ***B65H 9/04*** | (2006.01) |
| ***B65H 9/00*** | (2006.01) |
| ***B65H 9/10*** | (2006.01) |
| ***B65H 9/06*** | (2006.01) |
| ***B65H 5/06*** | (2006.01) |

(52) U.S. Cl.

CPC ..... *B65H 9/004* (2013.01); *B65H 9/106* (2013.01); *B65H 2404/5211* (2013.01); *B65H 2301/512125* (2013.01); *B65H 2801/06* (2013.01); *B65H 9/06* (2013.01); *B65H 5/068* (2013.01)

USPC ..... 271/230; 271/245

(58) Field of Classification Search

CPC ..... B65H 9/06; B65H 9/004; B65H 9/106; B65H 2404/521; B65H 2404/5211; B65H 2301/512125

USPC ..... 271/229, 230, 243, 245, 246

See application file for complete search history.

(56) References Cited

U.S. PATENT DOCUMENTS

| | | | | |
|---|---|---|---|---|
| 5,391,450 | A | 2/1995 | Nagatsuka et al. | |
| 6,011,948 | A * | 1/2000 | Amano et al. | 399/395 |
| 6,473,576 | B1 | 10/2002 | Koshimizu et al. | |
| 6,522,862 | B2 | 2/2003 | Koshimizu et al. | |

(Continued)

FOREIGN PATENT DOCUMENTS

| | | | |
|---|---|---|---|
| CN | 101165601 | A | 4/2008 |
| CN | 101165601 | B | 6/2010 |

(Continued)

*Primary Examiner* — Patrick Cicchino

(74) *Attorney, Agent, or Firm* — Fitzpatrick, Cella, Harper & Scinto

(57) ABSTRACT

An image forming apparatus including a sheet conveying portion which conveys a sheet to be formed with an image, and an abutment member which is abutted by the tip end of a sheet conveyed by the sheet conveying portion, and movable to a first attitude of being abutted by the tip end of the sheet being conveyed, and to a second attitude of allowing passage of the sheet and being in the state of abutting the surface of the sheet, wherein the abutment member in the second attitude abuts a part which is outside an image forming region and on the sheet surface having the image forming region in a central part in a width direction orthogonal to a sheet conveying direction.

12 Claims, 9 Drawing Sheets

(56) References Cited

U.S. PATENT DOCUMENTS

| | | | | |
|---|---|---|---|---|
| 6,934,505 | B2 * | 8/2005 | Shin | 399/395 |
| 7,308,227 | B2 * | 12/2007 | Ahn | 399/388 |
| 7,584,960 | B2 * | 9/2009 | Ha | 271/246 |
| 7,681,882 | B2 * | 3/2010 | Yu et al. | 271/243 |
| 7,720,429 | B2 * | 5/2010 | Lim | 399/388 |
| 7,731,175 | B2 * | 6/2010 | Kang | 271/110 |
| 7,887,039 | B2 | 2/2011 | Lee | |
| 8,215,637 | B2 * | 7/2012 | Yano | 271/226 |
| 8,308,159 | B1 * | 11/2012 | Manor et al. | 271/245 |
| 2003/0215274 | A1 * | 11/2003 | Ahn | 399/388 |
| 2004/0028438 | A1 | 2/2004 | Shin | |
| 2005/0191101 | A1 | 9/2005 | Ahn | |
| 2007/0086818 | A1 | 4/2007 | Ahn | |
| 2008/0093795 | A1 * | 4/2008 | Lee et al. | 271/245 |
| 2008/0143045 | A1 * | 6/2008 | Yu et al. | 271/245 |
| 2009/0250869 | A1 * | 10/2009 | Muller et al. | 271/245 |

FOREIGN PATENT DOCUMENTS

| | | | |
|---|---|---|---|
| EP | 0782967 | A1 | 7/1997 |
| EP | 0782967 | B1 | 6/2002 |
| EP | 1914599 | A1 | 4/2008 |
| JP | 11255377 | A | 9/1999 |

* cited by examiner

SHEET CONVEYING APPARATUS AND IMAGE FORMING APPARATUS

This is a divisional of U.S. patent application Ser. No. 13/182,504, filed Jul. 14, 2011, and allowed Nov. 19, 2012.

BACKGROUND OF THE INVENTION

1. Field of the Invention

The present invention relates to an image forming apparatus which forms an image on a sheet.

2. Description of the Related Art

In the related art, image forming apparatuses, such as a copying machine, a printer and a facsimile machine, are each provided with an image forming portion and a sheet conveying apparatus for conveying a sheet to the image forming portion by means of conveying rollers. Further, the sheet conveying apparatus may include an abutment member, which is provided in a sheet conveying path, and applied with a force in a direction opposite to a sheet conveying direction, and also moves from a position of being pressed by a sheet being conveyed to abut the sheet against the applied force to a position of allowing passage of the sheet while being in contact with the sheet.

Incidentally, in the conventional image forming apparatus, when a conveying roller is formed in taper shape or alignment of the conveying rollers is displaced, or in some other case, a sheet may be skew-fed during conveyance of the sheet. Especially when a sheet is fed from a cassette or a plurality of sheets is separated so as not to be simultaneously conveyed, skew feeding tends to occur since a roller width is small and the sheet cannot be sufficiently held for rotation. When the sheet is skew-fed as thus described, the accuracy in image forming position deteriorates.

Thereat, in the conventional image forming apparatus, a skew correcting portion is provided in the sheet conveying apparatus, and the accuracy in image forming position is sought to be improved by correcting skew feeding of the sheet in this skew correction portion. As such a skew correcting portion, for example, there is one provided with a shutter applied with a force by a spring or the like in a direction opposite to the sheet conveying direction, and makes this shutter abut the tip end of a sheet (see U.S. Pat. No. 6,011,948).

In the skew correcting portion using such a shutter, in the case of correcting skew feeding of a sheet, the sheet being skew-fed is first abutted by the shutter. Herein, when the sheet is being skew-fed, one of both ends of the sheet being skew-fed abuts the shutter. At this time, since the shutter being applied with a force by the spring or the like cannot move, the sheet in the end abuts the shutter as the entire tip end thereof follows a generating line of the shutter. Following the generating line of the shutter as thus described can correct skew feeding of the sheet.

Further, when the tip end of the sheet follows the generating line of the shutter as thus described, the shutter can then be rotated against the spring or the like applying the force to the shutter due to the stiffness of the sheet, so that the sheet can pass while rotating the shutter. In addition, for obtaining a favorable output image, it is important to correct skew feeding of a sheet before an image is transferred to the sheet in the image forming portion. Further, a position where the correction is made is more favorably closer to the image forming portion. Incidentally, in such conventional sheet conveying apparatus and image forming apparatus provided with this sheet conveying apparatus, when a sheet passes while rotating the shutter, the shutter comes to press the sheet surface.

Herein, the stronger the applied force that is applied to the shutter, the more the skew correcting ability improves, but when the applied force is thus made stronger, a pressing force that is applied to the sheet by the shutter increases.

Then, when the pressing force that is thus applied to the sheet increases, the surface of the sheet may be damaged. Especially, glossy paper or the like with a coated surface, which is used with the recent colorization, tends to be damaged on the surface, and a damage that occurs during passage through the shutter appears when a toner image is formed. Further, depending on a type of sheet, charging may occur due to friction that occurs during passage through the shutter, thereby to prevent accurate formation of a toner image. As thus described, although increasing the applied force that is applied to the shutter improves the skew correcting ability, it may cause deterioration in quality of an image formed on the sheet.

It should be noted that, other than the shutter, the conventional sheet conveying apparatus is provided with a conveying path switching member which switches the sheet conveying path as the abutment member that moves from a position of being pressed by a sheet being conveyed to abut the sheet to a position of allowing passage of the sheet while being in contact with the sheet surface. Also at the time of passage through such a conveying path switching member, although increasing an applied force of the conveying path switching member can reliably switch the sheet conveying path, the sheet may be damaged at the time of passage thereof, to cause deterioration in quality of an image formed on the sheet.

SUMMARY OF THE INVENTION

Thereat, the present invention was made in view of such a current condition, and provides a sheet conveying apparatus and an image forming apparatus which allow passage of a sheet without causing deterioration in image quality. The present invention is an image forming apparatus including a sheet conveying portion which conveys a sheet to be formed with an image, and an abutment member which is abutted by the tip end of a sheet conveyed by the sheet conveying portion, and movable to a first attitude of being abutted by the tip end of the sheet being conveyed, and to a second attitude of allowing passage of the sheet and being in the state of abutting the surface of the sheet, wherein the abutment member in the second attitude abuts a part which is outside an image forming region and on the sheet surface having the image forming region in a central part in a width direction orthogonal to a sheet conveying direction. As in the present invention, when located in the passage position, the abutment member is made to abut a part which is outside an image forming region and in each end portion of the sheet surface having the image forming region in a central part in a width direction, allowing passage of the sheet without causing deterioration in image quality.

Further features of the present invention will become apparent from the following description of exemplary embodiments with reference to the attached drawings.

DESCRIPTION OF THE EMBODIMENTS

Figure 1:
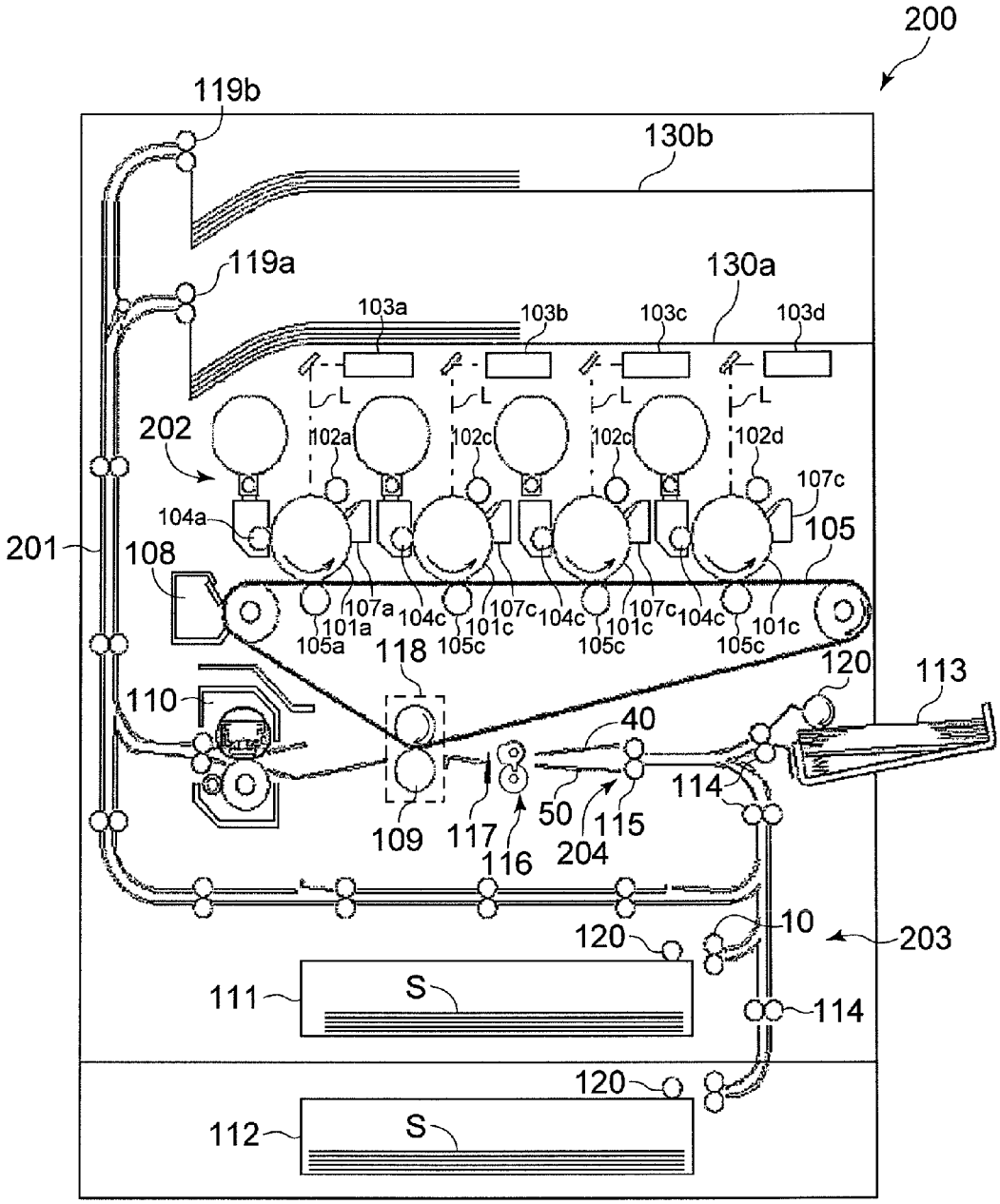
FIG. 1 is a view illustrating a schematic configuration of a color laser printer as an example of an image forming apparatus provided with a sheet conveying apparatus according to a first embodiment of the present invention.

In the following, modes for implementing the present invention are described with reference to the drawings. FIG. 1 is a view which illustrates a schematic configuration of a color laser printer as an example of an image forming apparatus provided with a sheet conveying apparatus according to a first embodiment of the present invention. In FIG. 1, a color laser printer 200 and a color laser printer body (hereinafter referred to as apparatus body) 201 are provided. This apparatus body 201 includes an image forming portion 202, a paper feeder 203 which feeds a sheet S to the image forming portion 202, a fixing portion 110, and the like.

The image forming portion 202 is provided with cylindrical photosensitive drums 101 (101*a* to 101*d*), primary chargers 102 (102*a* to 102*d*), and development devices 104 (104*a* to 104*d*) integrated with a toner cartridge. Further, the image forming portion 202 is provided with an endless intermediate transfer belt 106 where toner images of four colors, having been sequentially formed by the photosensitive drum 101, are sequentially primarily transferred, and secondary transfer rollers 109 which secondarily transfer to the sheet S the toner image having been primarily transferred to the intermediate transfer belt 106. It is to be noted that laser scanners 103 (103*a* to 103*d*) irradiate the photosensitive drums 101 with laser light L emitted according to an image signal.

The paper feeder 203 is provided with cassettes 111, 112 which accommodate the sheets S and are attachable and detachable to and from the apparatus body 201, and a manual paper feeder 113 and the sheets S are fed from the cassettes 111, 112 and the manual paper feeder 113 toward the image forming portion 202. On the upstream side from the image forming portion 202, a sheet conveying apparatus 204 is provided which conveys the sheet S, fed from the paper feeder 203, to the image forming portion 202. It is to be noted that this sheet conveying apparatus 204 includes conveying rollers 114, pre-registration rollers 115, a registration portion 116, which enhances the accuracy in attitude position of the sheet S and feeds out the sheet S with good timing according to the toner image on the intermediate transfer belt, and the like.

Next, an image forming operation of the color laser printer 200 with such a configuration will be described. When an image forming signal is output from a control device, not illustrated, which is provided in the apparatus body 201, an image signal, for example from an image reading portion, a personal computer which is not illustrated, is input into the laser scanner 103. This laser scanner 103 then emits laser light L based on this image signal, and irradiates the photosensitive drum 101 with this laser light. It is to be noted that at this time, the photosensitive drum 101 has been previously charged by the primary charger 102 to have a predetermined polarity and a predetermined voltage, and the photosensitive drum 101 is irradiated with the laser light, to be formed with an electrostatic latent image on the surface.

This electrostatic latent images are developed by means of the toner of the respective colors, to form toner images of the respective colors on the photosensitive drums, and the toner images of the respective colors are sequentially transferred to the intermediate transfer belt 106 by transfer biases that are applied to the primary transfer rollers 105 (105*a* to 105*d*). Thereby, a full-color toner image is formed on the intermediate transfer belt. It is to be noted that transfer residual toners on the photosensitive drums are collected by drum cleaners 107 (107*a* to 107*d*).

Further, concurrently with this toner image forming operation, the sheet S accommodated in the cassette 111 or 112 or the manual paper feeder 113 is fed out by a pickup roller 120. Thereafter, this sheet is conveyed toward the registration portion 116 as the skew correcting portion by the conveying rollers 114 and the pre-registration rollers 115 as the sheet conveying portion. It should be noted that a conveying speed of the sheet S at this time is a speed higher than a circumferential speed (process speed) of the image forming portion 202, namely the photosensitive drum 101 and the intermediate transfer belt 106. In the present embodiment, the process speed is set to 150 mm/s and a sheet conveying speed is set to 200 mm/s in the case of plain paper as an example.

Next, the sheet conveyed to the registration portion 116 in this manner is corrected in terms of skew feeding in the registration portion 116, and the tip end thereof is then detected by the registration sensor 117. Based on the detection of the tip end, the control device, not illustrated, computes timing for decreasing the conveying speed of the sheet S in the registration portion 116 to the process speed such that the tip end of the image formed on the intermediate transfer belt is aligned with the tip end of the sheet in a secondary transfer portion 118.

Then, at such a speed, the toner image on the intermediate transfer belt 106 is transferred by secondary transfer external rollers 109 to the sheet S conveyed to the secondary transfer portion 118, and thereafter, the transferred toner image is heated and pressurized in the fixing device 110, to be fixed onto the sheet. Next, the sheet S fixed with the toner image in this manner is discharged from a discharge portion 119*a* or 119*b* onto a discharge tray 130*a* or 130*b* provided in the apparatus body 201. It should be noted that the transfer residual toner on the intermediate transfer belt 106, which was not transferred in the secondary transfer portion 118 is collected by an intermediate transfer member cleaner 108.

Figure 2A:
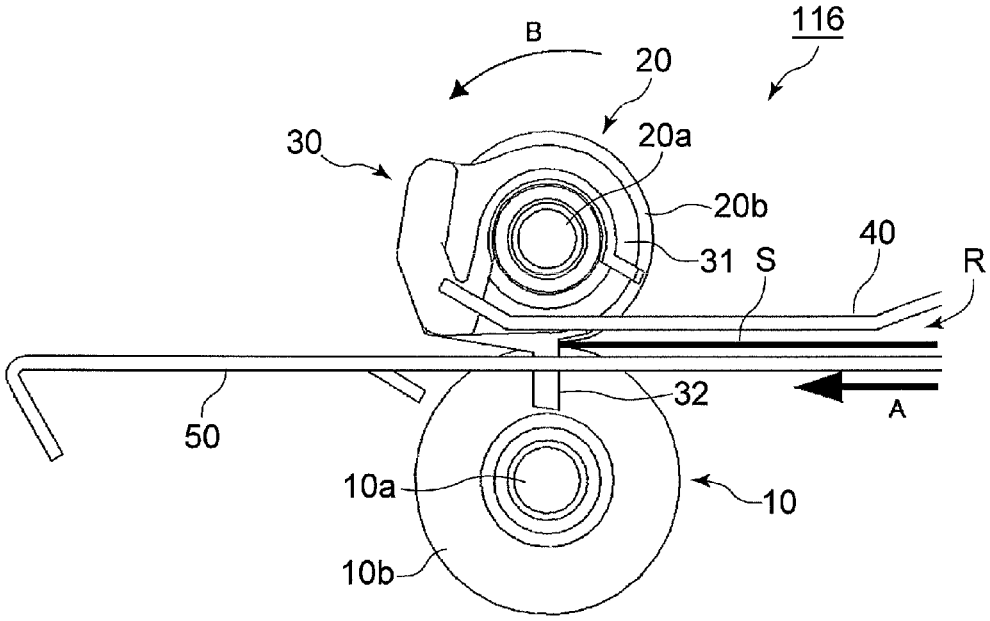
FIGS. 2A and 2B are sectional views describing a configuration of a registration portion provided in the sheet conveying apparatus.
Figure 2B:
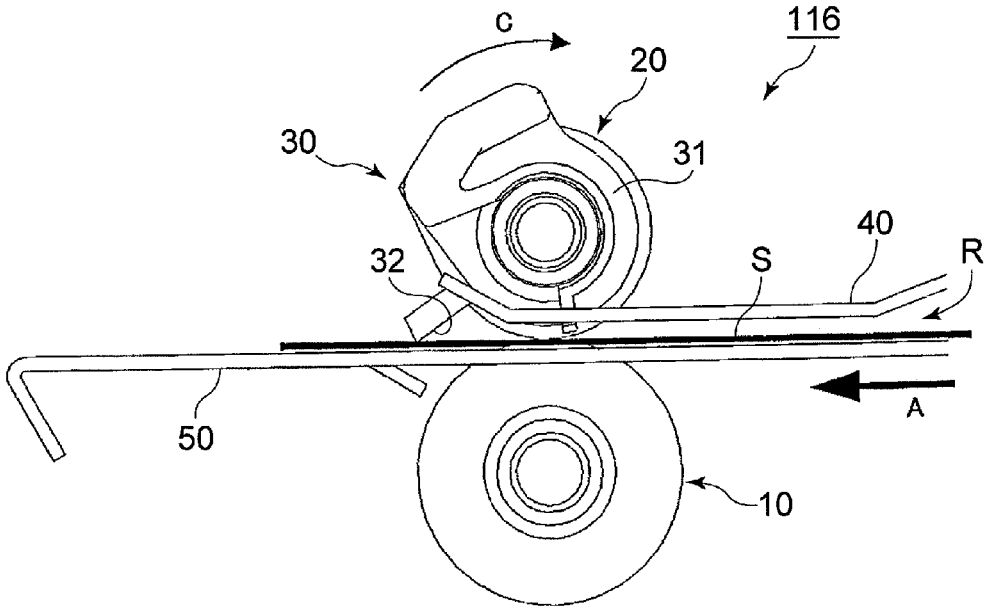

Incidentally, as illustrated in FIGS. 2A and 2B, the registration portion 116 is provided with a pair of registration rollers 10, 20 as a pair of rotating members made up of a registration lower roller 10 and a registration upper roller 20, and a shutter 30 as a shutter member (abutment member). In addition, the registration lower roller 10 and the registration upper roller 20 as the rotating members are rotatably supported by bearings, not illustrated, in the vicinities of both ends in axial directions (width directions) orthogonal to the sheet conveying direction, and are also pressurized by springs, not illustrated, to form a nip.

Further, the registration lower roller 10 has a plurality of rubber rollers 10*b* fixed at predetermined intervals in the axial direction of a metal shaft 10*a*. The registration upper roller 20 has a plurality of polyacetal-made rollers 20*b* provided so as to be opposed to the rubber rollers 10*b* in the axial direction of the metal shaft 20*a*. In addition, an outer diameter of the rubber roller 10*b* and an outer diameter of the roller 20*b* are 16 mm.

On the downstream side from this pair of registration rollers 10, 20 in the sheet conveying direction (direction of an arrow A), the shutter 30 is arranged along the pair of registration rollers 10, 20 in the axial direction. The shutter 30 is integrally formed with a plurality of regulating pieces 31 in half-arc shape, and at the tip end on the lower portion of each regulating piece 31, an abutment face (abutment portion) 32 is formed which abuts the tip end of the sheet being conveyed by the pre-registration rollers 115. Specifically, each of the regulating piece 31 is located among the plurality of rubber rollers 10*b* of the registration lower roller 10 or at each side thereof. That is, each regulating piece 31 is located among the plurality of nips formed by the rubber rollers 10*b* and the rollers 20*b*, or at each end thereof in the pair of registration rollers 10, 20 in the axial direction.

Further, the regulating piece 31 at each end is integrally formed with the bearing, not illustrated, and is rotatably supported in the metal shaft 20*a* of the registration upper roller 20, whereby the shutter 30 is rotated with the metal shaft 20*a* of the registration upper roller 20 at the center when pressed by the sheet. Each of the regulating piece 31 is arranged in a symmetrical position with respect to the center of the pair of registration rollers 10, 20 in the axial direction. With the plurality of regulating pieces 31 arranged as thus described, it is possible to handle sheets S having a variety of lengths in the width direction. In FIGS. 2A and 2B, an upper guide 40 and a lower guide 50 form a sheet conveying path R.

Figure 3:
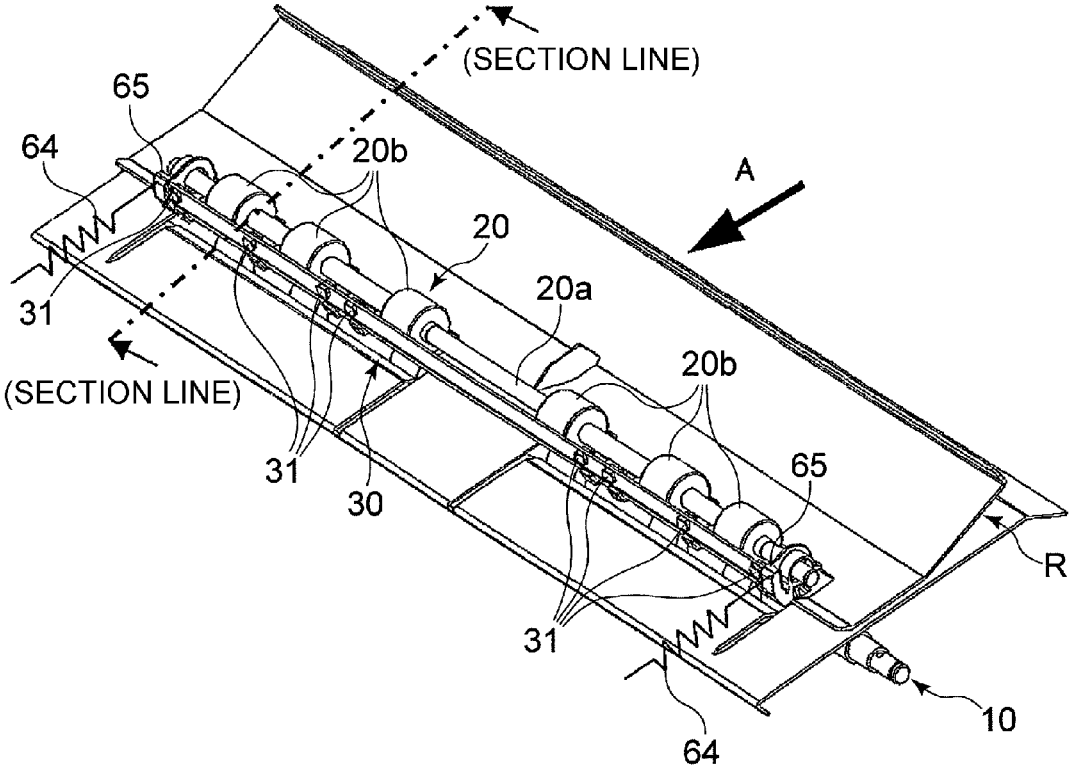
FIG. 3 is a perspective view describing a configuration of the registration portion.

Incidentally, as illustrated in FIG. 3, a spring hooked portion 65 and a stopper portion, not illustrated, are formed on one end side of the shutter 30, and a tension coil spring 64 as a force applying unit is hooked on the spring hooked portion 65. Then, the shutter 30 is applied with a force by a spring force of the tension coil spring 64 in a counterclockwise direction (direction of an arrow B) as illustrated in FIG. 2A. In a state where the sheet is not being conveyed, the stopper portion, not illustrated, of the shutter 30 abuts a projecting piece, not illustrated, which is provided in the apparatus body 201. Accordingly, when the sheet is not being conveyed, with the abutment face 32 of each regulating piece 31 being in a state vertical to the sheet conveying path R, the shutter 30 is held in the state (first attitude) of being located slightly on the upstream side from the nip of the pair of registration rollers 10, 20 in the sheet conveying direction.

On the other hand, as described below, when skew feeding of the sheet is corrected, the tip end of the sheet comes to abut the abutment faces 32 of all of the regulating pieces 31. In this case, a force pressed by the tip end of the sheet to the shutter 30 comes to overcome the applied force of the tension coil spring 64, resulting in that the shutter 30 is rotated in a clockwise direction (direction of arrow C) with the registration upper roller 20 at the center as illustrated in FIG. 2B. In the course of the shutter 30 being pressed by the tip end of the sheet and thereby rotated, the sheet is caught by the pair of the registration rollers 10, 20.

Next, a skew correcting operation in the registration portion 116 provided with the shutter 30 configured as above will be described with reference to FIGS. 4A and 4B as a view of the sheet S being conveyed by the pre-registration rollers 115 to the registration portion 116, seen from the top side of the conveying path. Incidentally, although the driving portions of the pair of registration rollers 10, 20 and the pre-registration roller 115 are not illustrated in FIGS. 4A and 4B, the pair of registration rollers 10, 20 and the pre-registration roller 115 are driven by the same one driving portion. Further, the conveying speeds of these two sorts of rollers are set such that the conveying speed of the pre-registration rollers 115 is higher than that of the pair of registration rollers 10, 20 by the order of 1%. This is aimed at preventing the conveying speed of the pair of registration rollers 10, from being lower than the conveying speed of the pre-registration rollers 115 due to component tolerance, and ideally, the conveying speeds of the two sorts of rollers may be the same.

Figure 4A:
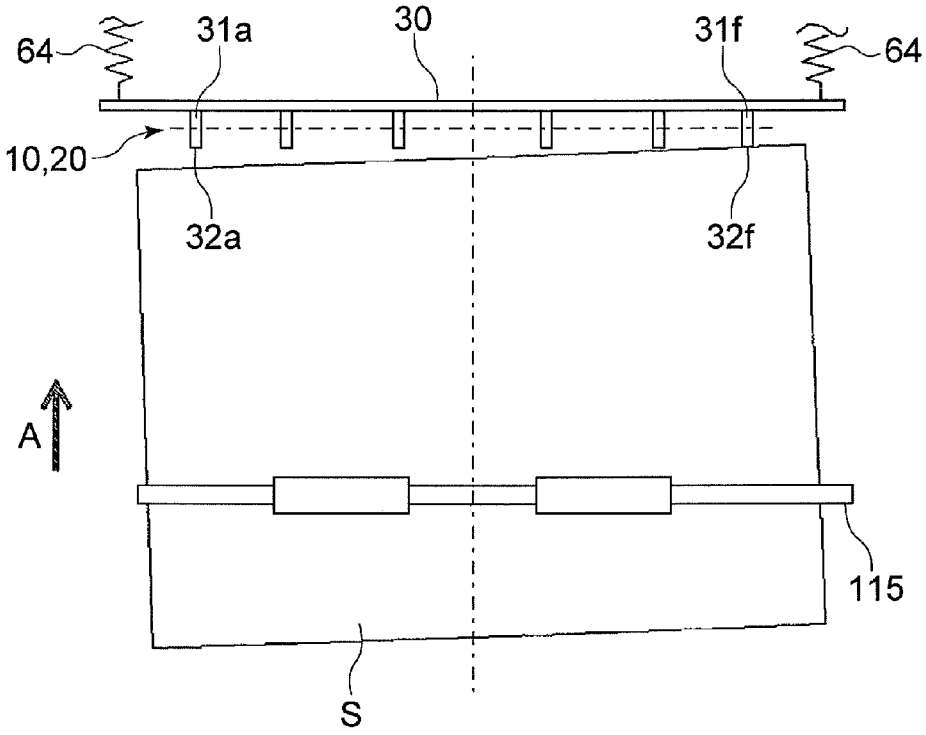
FIGS. 4A and 4B are views describing a registration operation by a shutter provided in the registration portion.
Figure 4B:
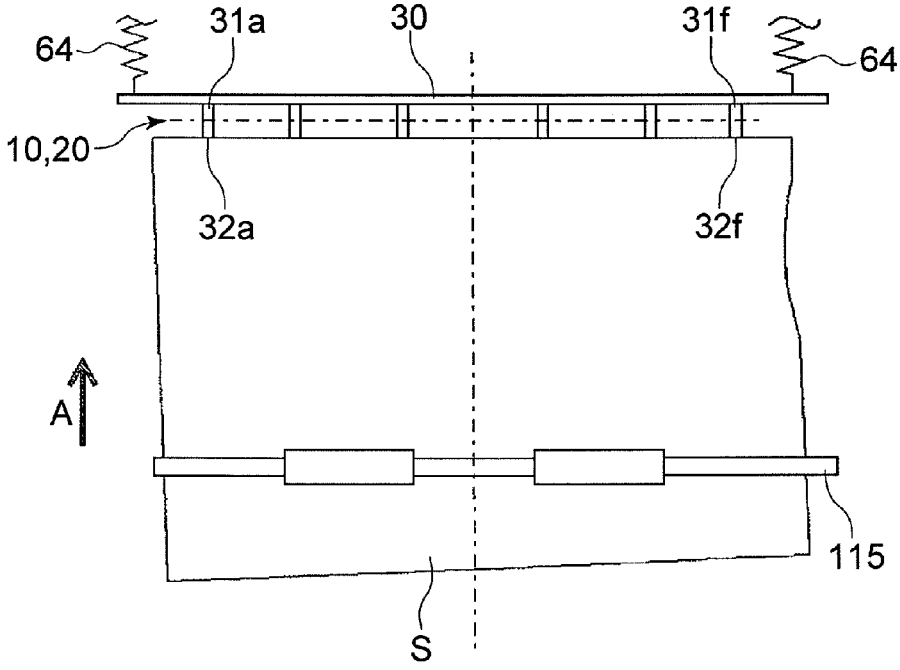

Herein, as illustrated in FIG. 4A, when the sheet S is being conveyed in a direction of an arrow A in a state where its right end is ahead of its left end, with respect to the pair of registration rollers 10, 20, first, the right end of the sheet S abuts an abutment face 32*f* of a regulating piece 31*f* on the right side. At this time, since the force pressed by the sheet S to the shutter 30 is smaller than the applied force of the tension coil spring 64 which is being applied to the shutter 30, the sheet S cannot rotate the shutter 30 against the applied force of the tension coil spring 64. Therefore, in this state, the sheet S is prevented from moving in the part abutted by the regulating pieces 3, and then forms a loop.

With the sheet S being skew-fed, the left end of the sheet S has not abutted an abutment face 32*a* of a regulating piece 31*a* on the left side. Hence the conveyance is continued by the pre-registration rollers 115 on one side, namely the left side, of the sheet having not abutted the regulating piece 31*a*. Accordingly, thereafter, the left end of the sheet S having not been abutting the abutment face 32*a* of the regulating piece 31*a* on the left side comes into the state of abutting the abutment face 32*a* of the regulating piece 31*a*, as illustrated in FIG. 4B.

When both the right and left ends of the sheet S come to abut the abutment faces 32*a*, 32*f* of the respective regulating pieces 31*a*, 31*f* provided in the vicinities of both ends of the shutter 30 as described above, the force pressed by the tip end of the sheet to the shutter 30 comes to overcome the applied force of the tension coil spring 64. As a result, integrally with the regulating piece 31, the shutter 30 is rotated by the sheet S with the registration upper roller 20, which is a rotational center of the shutter 30, at the center.

In this state, the sheet S is in a state where both right and left ends of the tip end thereof abut the abutment faces 32 of each regulating piece 31, thus being located in the same position with respect to the sheet conveying direction, and skew feeding has been corrected. Although the case of the sheet S being skew-fed in the left direction as illustrated in FIG. 4A has been described in the present embodiment, it is obvious that, also in the case of the sheet S being skew-fed in the opposite direction (right direction), feeding correction can be performed in a similar manner.

Next, when the shutter 30 is rotated as thus described, the sheet S is conveyed again without an obstacle, and gets into the nip of the rubber roller 10*a* of the registration lower roller 10 and the roller 20*a* of the registration upper roller 20 while the skew corrected state is held. Thereafter, the sheet S is conveyed to the secondary transfer portion while the skew corrected state is held. At this time, the shutter 30 is rotated (moves) to the passage position (second attitude) of allowing the sheet to pass therethrough while abutting the sheet surface against the applied force, and even in a state where the regulating piece 31 is retracted, the regulating piece 31 is pressed to the sheet S with the applied force by the tension coil spring 64.

Figure 5A:
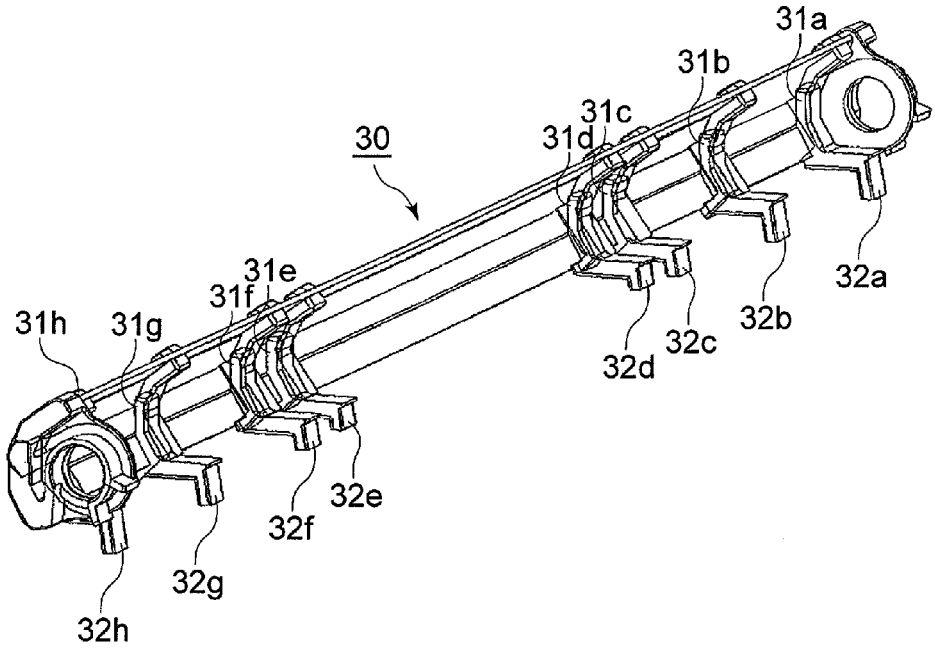
FIGS. 5A and 5B are views describing a configuration of the shutter provided in the registration portion.
Figure 5B:
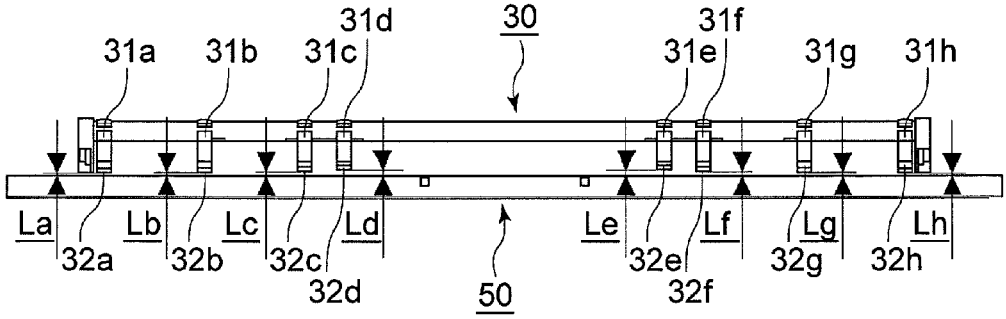

Incidentally, the shutter 30 is provided with the plurality of regulating pieces 31 abutting both end portions of the sheet being conveyed in the width direction in positions corresponding to the lengths of the sheets S in the width direction, the sheet S having a variety of lengths in the width direction. Specifically, as illustrated in FIGS. 5A and 5B, when sheets with different lengths in the width direction are being conveyed, the plurality of regulating pieces (31*a* to 31*h*) which are provided in the shutter 30 in the axial direction are arranged in positions corresponding to the outside of an image formation (margin forming portion) and slightly the inside of both ends of the sheet in the width direction. Hence the sheet S is conveyed to the secondary transfer portion while the regulating pieces 31 located in positions corresponding to the length of the sheet S in the width direction are pressed to the outside of the image forming region.

Herein, as described above, the sheet S performs the operation of rotating the shutter 30 due to the stiffness of the sheet S, and the sheet S being thick paper with a large basis weight rotates the shutter 30 with a relatively larger force. For this reason, when the applied force of the shutter 30 is excessively weak, the shutter 30 may be rotated just by abutment of part of the sheet S, being skew-fed, to the regulating piece 31, resulting in insufficient skew correction. Accordingly, in the present embodiment, the applied force to the shutter 30 is set to the order of 4 to 5 N.

However, in the case of setting the applied force as thus described, when the sheet is conveyed while rotating the shutter 30, the sheet top face is pressed by the regulating piece 31 with the order of 4 to 5 N. When the sheet top face is pressed by the regulating piece 31 with such a large applied force, the sheet surface may be damaged due to contact pressure by the regulating piece 31.

Thereat, in the present embodiment, as illustrated in FIG. 5A, the length of the abutment face (32*a* to 32*h*), constituting the abutment part that abuts the regulating piece 31, on the lower side is made larger as getting closer to the outside the shutter 30 in the axial direction. That is, the length of the abutment face 32 (32*a* to 32*h*) in the vertical direction is made larger as getting closer to each end from the center in the sheet width direction.

Thereby, in a state where the shutter 30 is rotated and the regulating piece 31 is retracted as illustrated in FIG. 2B, a space between the lower guide 50 and each of the regulating pieces 31*d*, 31*e* located in the central portion of the shutter 30 in the axial direction is the largest, as illustrated in FIG. 5B. Further, a space between the lower guide 50 and each of the regulating pieces 31*a*, 31*h* located at both ends in the axial direction is the smallest. That is, the space between each of the plurality of regulating pieces 31 and the lower guide 50 is expressed as in the following equation:

$$Ld(\approx Le)>Lc(\approx Lf)>Lb(\approx Lg)>La(\approx Lh)$$

With such a configuration formed, for example at the time of conveying a sheet with the largest length in the width direction, when the shutter 30 is rotated, the sheet first moves while pressing all the regulating pieces 31. Thereafter, however, as the sheet is conveyed, the regulating pieces 31*b* to 31*g* on the center side come to be separated from the image forming region in the central part of the sheet surface in the width direction due to the difference in length in the vertical direction. Thereby, only the regulating pieces 31*a*, 31*h*, located outside the image forming region and slightly inside both ends of the sheet in the width direction, come to press the sheet S.

Consequently, when conveyed while rotating the shutter 30, the sheet S is applied with a force from the regulating piece 31 outside the image forming region, whereby charging that occurs due to damage or friction in the image forming region can be minimal, so as to minimize an influence on the image. It is thereby possible to reliably correct skew feeding of the sheet without causing deterioration in quality of an image on the sheet. When the sheet is conveyed in the state of being bent in the vertical direction, the regulating pieces 31*b* to 31*g* on the center side may abut the image forming region in the central part of the sheet surface. However, even in this case, since the regulating pieces 31*b* to 31*g* on the center side are configured so as to be separated from the image forming region in the central part of the sheet surface, the regulating pieces 31*b* to 31*g* apply a small pressing force to the sheet even when abutting the sheet, thereby not causing deterioration in image quality.

As described above, in the present embodiment, the shutter 30 is formed into such a shape that, when the shutter 30 moves by being pressed by the sheet, the contact pressure with the sheet is larger on the outer side (each end side) than at the center of the sheet in the width direction. Thereby, when pressed by the sheet, the shutter 30 can be moved toward the passage position while abutting a part which is outside the image forming region and in each end portion of the sheet surface. Consequently, when located in the passage position, the shutter 30 can be made to abut a part which is outside the image forming region and in the each end portion of the sheet surface having the image forming region in the central part in the width direction. With such a configuration formed, it is possible to allow passage of the sheet while reliably correcting skew feeding thereof without causing deterioration in image quality regardless of the type of sheet in use.

Figure 6:
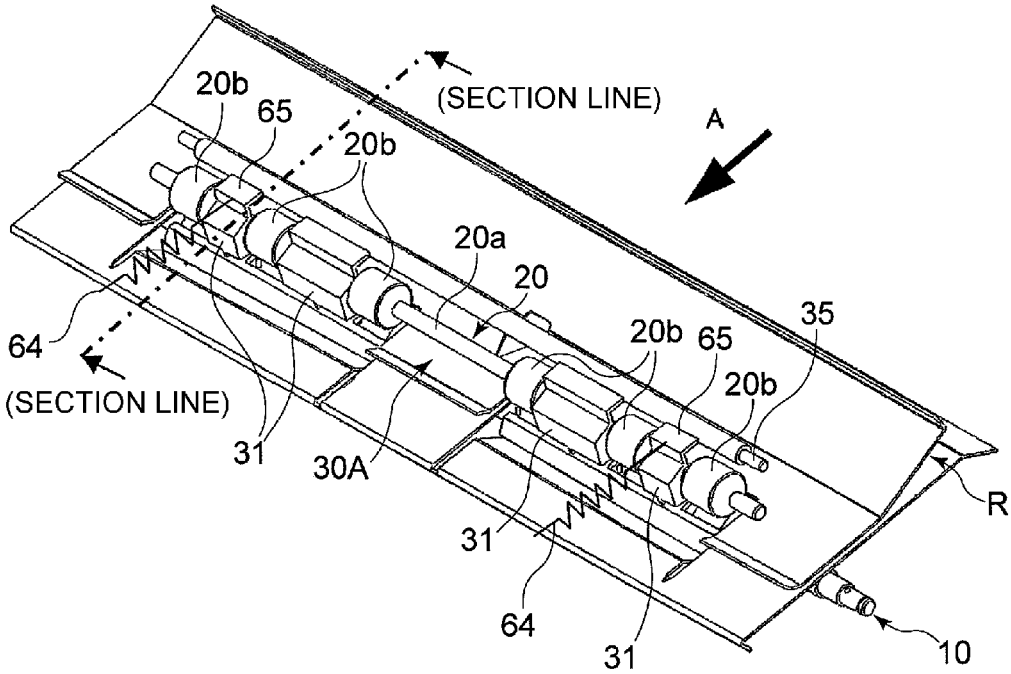
FIG. 6 is a perspective view describing a configuration of a registration portion provided in a sheet conveying apparatus according to a second embodiment of the present invention.

Next, a second embodiment of the present invention will be described. FIG. 6 is a perspective view describing a configuration of a registration portion provided in a sheet conveying apparatus according to the present embodiment. In FIG. 6, the same numerals as in FIG. 3 denote the same or corresponding parts.

In FIG. 6, a rotation shaft 35 is provided in an upper end portion of a shutter 30A. The shutter 30A is rotatably supported by the apparatus body 201 via this rotation shaft 35. Further, this shutter 30A is integrally formed with a plurality of regulating pieces 31 in half-arc shape in the axial direction. At the tip end of the lower portion of each regulating piece 31, as illustrated in FIG. 7, an abutment face 32 is provided which abuts the tip end of the sheet being conveyed by the pre-registration rollers 115.

Figure 7A:
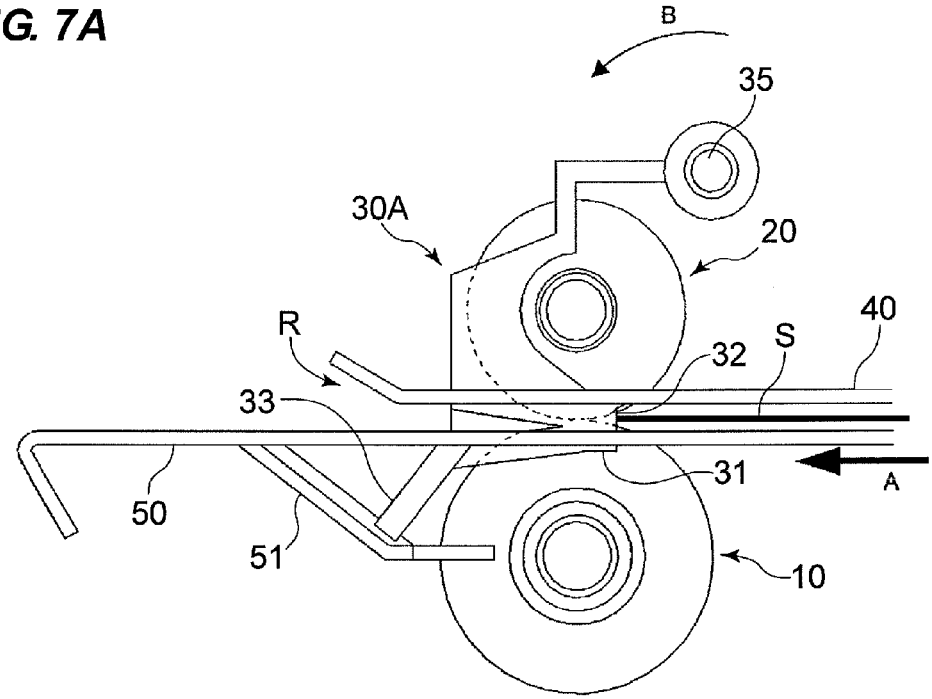
FIGS. 7A and 7B are views describing a registration operation of the registration portion.
Figure 7B:
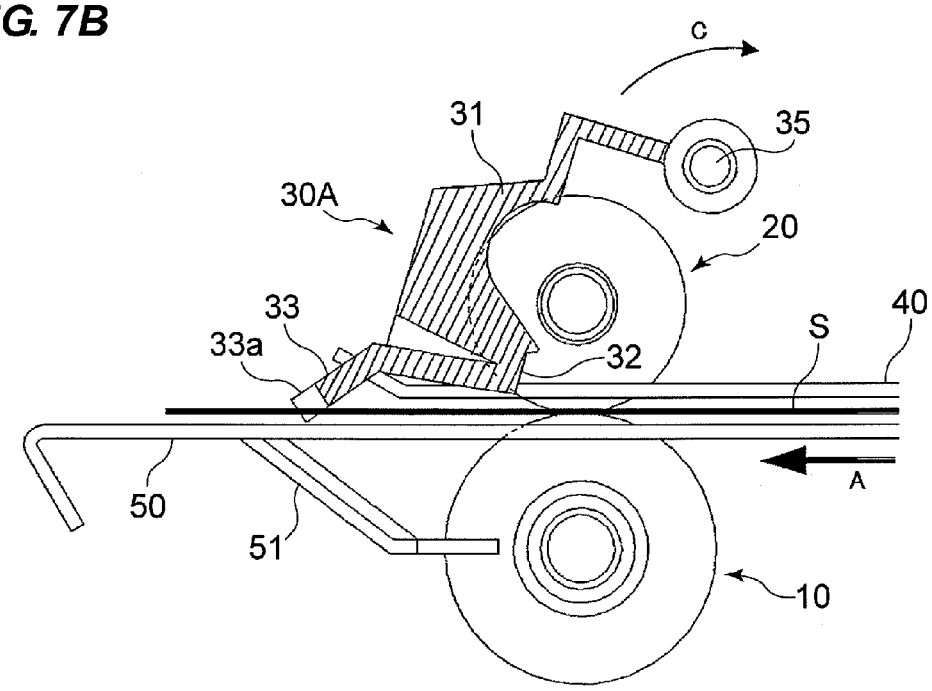
Figure 8:
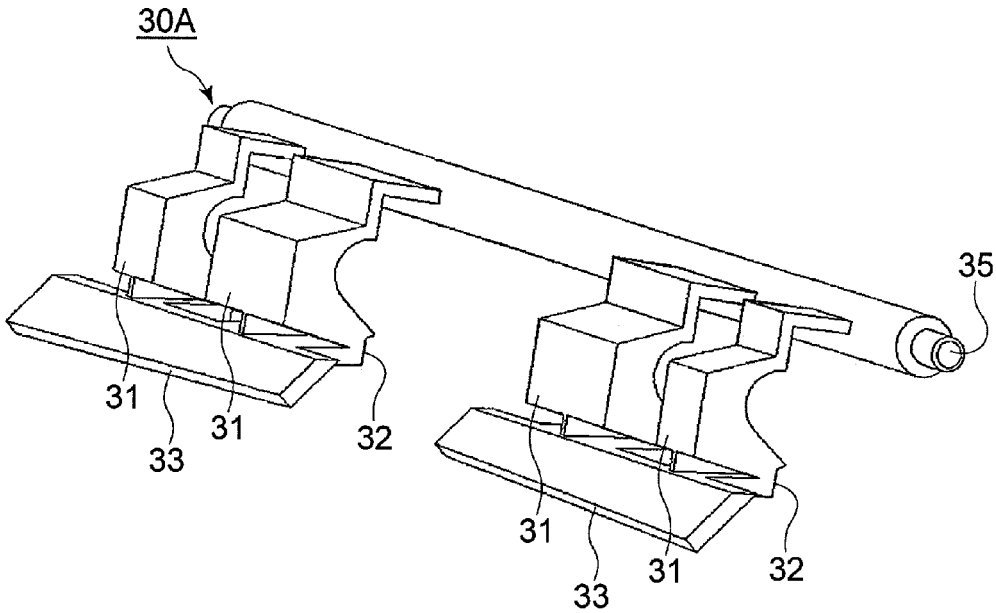
FIG. 8 is a perspective view describing a configuration of a shutter provided in the registration portion.

Moreover, on the bottom face of the regulating piece 31, a pressing portion 33 extending in the width direction is provided which guides the upper face of the sheet S at the time of the regulating piece 31 being pressed by the sheet S and rotated. In the present embodiment, this pressing portion 33 is provided so as to be inclined on the downstream side in the sheet conveying direction, while being integrally provided with two regulating pieces 31 located on each side of the shutter 30A in the axial direction, as illustrated in FIG. 8. In FIGS. 7A and 7B, a stopper 51 abuts the pressing portion 33 to regulate rotation of the shutter 30A, and by this stopper 51, the shutter 30A is held in a position of making the sheet S, being conveyed, abut the abutment faces 32.

Herein, in a state where the sheet S is not being conveyed, the shutter 30A is applied with a force by a spring force of the tension coil spring 64 in a counterclockwise direction (direction of an arrow B) as illustrated in FIG. 7A. On the other hand, when skew feeding of the sheet S is corrected, the tip end of the sheet S comes to abut the abutment faces 32 of all of the regulating pieces 31. Thereby, the force pressed by the tip end of the sheet to the shutter 30A comes to overcome the applied force of the tension coil spring 64, resulting in that the shutter 30A is rotated in a clockwise direction (direction of arrow C) with the rotation shaft 35 as a fulcrum as illustrated in FIG. 7B.

Figure 9A:
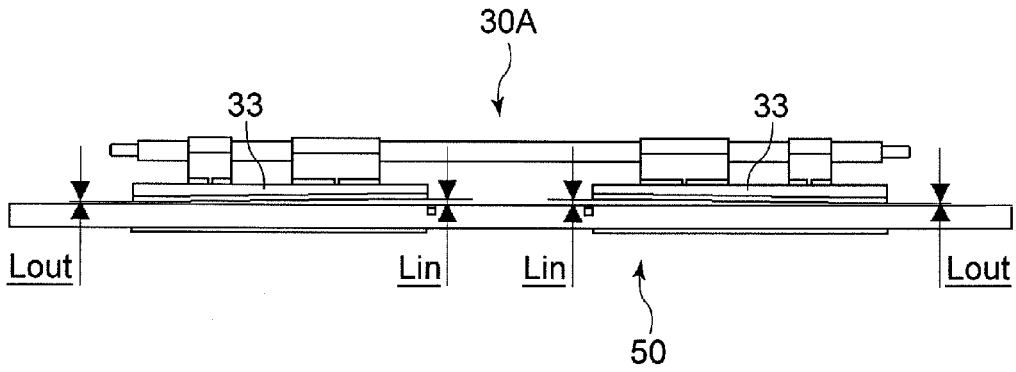
FIGS. 9A and 9B are views describing an operation of the shutter.
Figure 9B:
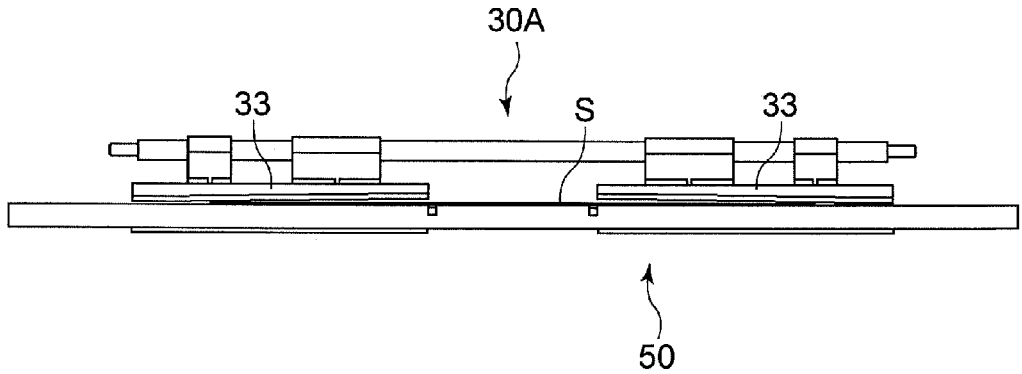

Incidentally, the guide tip end of the pressing portion 33, which is provided in the shutter 30A and inclined downward, extends more as getting closer to the outside in the axial direction. That is, the pressing portion 33 has a larger length in the vertical direction as getting closer to each end from the center in the sheet width direction. Thereby, in a state where the shutter 30A is rotated and the regulating piece 31 is retracted as illustrated in FIG. 7B, a space between the pressing portion 33 and the lower guide 50 has a larger width as getting closer to the central portion and has a lower width as getting closer to each end of the shutter 30A in the axial direction, as illustrated in FIG. 9B. Similarly, a space between the pressing portion 33 and the sheet S also has a larger width as getting closer to the central portion and has a lower width as getting closer to each end of the shutter 30A in the axial direction, as illustrated in FIG. 9B (Lout>Lin).

Herein, as described above, the operation of the sheet S to rotate the shutter 30A is performed due to the stiffness of the sheet S, but even in the state where the shutter 30A is rotated and the regulating piece 31 is retracted, the pressing portion 33 is pressed to the sheet S with the applied force by the spring. However, since the length of the downwardly inclined pressing portion 33 in the vertical direction is made larger as getting closer to the outside in the axial direction, when the shutter 30A is rotated, the regulating piece 31 comes into the state of being most strongly pressed at each end of the sheet S in the width direction. Further, the force with which the pressing portion 33 is pressed to the sheet S is smaller in a position closer to the central portion of the sheet S.

Consequently, when conveyed while rotating the shutter 30A, the sheet S is applied with a force from the regulating piece 31 outside the image forming region, whereby charging that occurs due to damage or friction in the image forming region can be minimal, so as to minimize an influence on the image.

As described above, as in the present embodiment, since the length of the pressing portion 33 in the vertical direction is made larger as getting closer to the outside of the axial direction, it is possible to reliably correct skew feeding of the sheet without causing deterioration in quality of an image on the sheet. Further, since the length of the pressing portion 33 in the vertical direction is made larger as getting closer to the outside in the axial direction, it is possible to reliably correct skew feeding of the sheet of any size without causing deterioration in quality of an image on the sheet.

It should be noted that, although specific values of the process speeds, the applied force to the shutter and the like for plain paper and thick paper have been mentioned in the above description, the present invention is not restricted to these numeral values. Further, although the registration portion located immediately before the image forming portion has been described above, it may be located in any place so long as serving to correct skew feeding of a sheet.

Further, although the present invention has been described above by taking the image forming apparatus of the electrophotographic system as the example, it can also be applied to an image forming apparatus which performs a similar skew correcting operation, such as an image forming apparatus of an inkjet system. Moreover, although the skew correcting portion has been described in the present embodiment, the present invention can also be applied to the conveying path switching member arranged inside the sheet conveying path, and also in this case, damage, friction and the like of the sheet surface can be prevented so as to obtain a similar effect.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-165158, filed Jul. 22, 2010, which is hereby incorporated by reference herein in its entirety.

What is claimed is:

1. A sheet conveying apparatus, comprising:

a sheet conveying portion which conveys a sheet;

a pair of rotating members which conveys the sheet disposed at downstream side of the sheet conveying portion, and an abutment unit which rotates around a rotation axis between a first attitude of being abutted by the leading edge of the sheet conveyed and a second attitude of being in the state of abutting the surface of the sheet passing, the abutment unit having a pair of first abutting portions, disposed in a width direction perpendicular to a sheet conveying direction, which to which a leading edge of the sheet conveyed by the sheet conveying portion abuts and a pair of second abutting portions, disposed in the width direction, which to which the leading edge of the sheet conveyed by the sheet conveying portion abuts at more inner side in the width direction, wherein a leading edge of a maximum size sheet which the sheet conveying apparatus can convey abuts the pair of first butting portions and the pair of second butting portions upstream of a nip portion of the pair of rotating members and a leading edge of a minimum size sheet which the sheet conveying apparatus can convey abuts the pair of second abutting portions upstream of the nip portion of the pair of rotating member, and wherein one abutting portion among the pair of first abutting portions and the pair of the second abutting portions has a longer distance from the center of rotation to the farthest point thereof than those distance of the other one abutting portions among the pair of first abutting portions and the pair of the second abutting portions.

2. The sheet conveying apparatus according to claim 1, further comprising a tensioning member for pushing the abutting unit into the first attitude, wherein the sheet could push to rotate the abutting unit to the second attitude from the first attitude against a tension by the tensioning member.

3. The sheet conveying apparatus according to claim 1, the sheet conveying portion conveys a sheet to be formed with an image by an image forming portion, and the abutment unit in the second attitude abuts a part which is outside an image forming region of the sheet.

4. A sheet conveying apparatus, comprising:

a sheet conveying portion which conveys a sheet;

a pair of rotating members which conveys the sheet disposed at downstream of the sheet conveying portion, and an abutment unit which rotates around a rotation axis between a first attitude where it is abutted by the leading edge of the sheet conveyed and a second attitude where it abuts the surface of the sheet passing, the abutting unit having a pair of first abutting portions, disposed in a width direction perpendicular to a sheet conveying direction, to which a leading edge of the sheet conveyed by the sheet conveying portion abuts and a pair of second abutting portions, disposed in the width direction, to which the leading edge of the sheet conveyed by the sheet conveying portion abuts at more inner side of the abutment unit in the width direction, wherein a leading edge of a sheet having a first size abuts the pair of first abutting portions and the pair of second abutting portions to rotate the abutment unit from the first attitude to the second attitude by a force from the sheet having the first size, and during the rotation of the abutment unit, the sheet maintains contact with the pair of first abutting portions until the sheet having the first size is nipped by the pair of rotation members, wherein a leading edge of a sheet having a second size which is smaller than the first size abuts the pair of the second abutting portions to rotate the abutment unit from the first attitude to the second attitude by a force from the sheet having the second size, and during the rotation of the abutment unit, the sheet maintains contact with the pair of first abutting portions until the sheet having the second size is nipped by the pair of the rotation members, and wherein the pair of first abutting portions have a longer distance from the center of rotation to the farthest point thereof than those distances of the pair of second abutting portions.

5. The sheet conveying apparatus according to claim 4, further comprising a tensioning member for pushing the abutting unit into the first attitude, wherein the sheet could push to rotate the abutting unit to the second attitude from the first attitude against a tension by the tensioning member.

6. The sheet conveying apparatus according to claim 4, the sheet conveying portion conveys a sheet to be formed with an image by an image forming portion, and the abutment unit in the second attitude abuts a part which is outside an image forming region of the sheet.

7. An image forming apparatus comprising, the sheet conveying apparatus according to claim 1, and an image forming portion which forms image on a sheet conveyed by the sheet conveying apparatus.

8. The image forming apparatus according to claim 7, further comprising a tensioning member for pushing the abutting unit into the first attitude, wherein the sheet could push to rotate the abutting unit to the second attitude from the first attitude against a tension by the tensioning member.

9. The image forming apparatus according to claim 7, wherein the image forming portion forms image on a part outside a region where the abutment unit in the second attitude abuts.

10. The image forming apparatus according to claim 7, wherein the pair of first abutting portions have a longer distance from the center of rotation to the farthest point thereof than those distances of the pair of second abutting portions.

11. The sheet conveying apparatus according to claim 4, wherein the abutment unit further comprises a pair of a third abutting portions which is disposed to align in the width direction at inside of the pair of the second abutting portions, wherein a leading edge of a sheet having a third size which is smaller than the second size abuts to the pair of the third abutting portions to rotate the abutment unit from the first attitude to the second attitude by a force from the sheet having the third size, and during the rotation of the abutment unit, the sheet keep being touch with the pair of the first abutting portion until the sheet having a third size is nipped by the pair of the rotation member, wherein a longest length between the rotation axis and the pair of second abutting portions is longer than a longest length between the rotation axis and the pair of the third abutting portions, and wherein the pair of second abutting portions have a longer distance from the center of rotation to the farthest point thereof than those distances of the pair of third abutting portions.

12. The sheet conveying apparatus according to claim 1, wherein the pair of first abutting portions have a longer distance from the center of rotation to the farthest point thereof than those distances of the pair of second abutting portions.

* * * * *